United States Patent [19]

Handler

[11] Patent Number: 5,007,366

[45] Date of Patent: Apr. 16, 1991

[54] REFRACTORY GAS PERMEABLE BUBBLING PLUG

[75] Inventor: Rudolf Handler, Neunkirchen, Austria

[73] Assignee: Veitscher Magnesitwerke-Actien-Gesellschaft, Vienna, Austria

[21] Appl. No.: 457,766

[22] PCT Filed: Apr. 13, 1989

[86] PCT No.: PCT/AT89/00035

§ 371 Date: Nov. 28, 1989

§ 102(e) Date: Nov. 28, 1989

[87] PCT Pub. No.: WO89/09836

PCT Pub. Date: Oct. 19, 1989

[30] Foreign Application Priority Data

Apr. 13, 1988 [AT] Austria ..... 958/88

[51] Int. Cl.[5] ..... C21B 7/24; G01D 5/26; C21C 5/48

[52] U.S. Cl. ..... 116/208; 116/283; 266/220; 266/99

[58] Field of Search ..... 116/208, 218, 283; 73/86; 266/99, 100, 265, 270, 93, 220

[56] References Cited

U.S. PATENT DOCUMENTS

| | | | |
|---|---|---|---|
| 3,856,284 | 12/1974 | Hoyer | 266/220 |
| 4,385,752 | 5/1983 | Hayashi | 266/270 |
| 4,481,809 | 11/1984 | LaBate | 73/86 |
| 4,560,149 | 12/1985 | Höffgen | 266/265 |
| 4,711,432 | 12/1987 | Heinz et al. | 266/220 |
| 4,741,515 | 5/1988 | Sharma et al. | 266/99 |
| 4,744,544 | 5/1988 | LaBate et al. | 73/86 |
| 4,779,849 | 10/1988 | Rothfuss et al. | 266/270 |
| 4,944,496 | 7/1990 | Thrower et al. | 266/220 |

FOREIGN PATENT DOCUMENTS

| | | | |
|---|---|---|---|
| 0082078 | 7/1985 | European Pat. Off. . | |
| 3142989 | 11/1983 | Fed. Rep. of Germany . | |
| 3424466 | 1/1985 | Fed. Rep. of Germany . | |
| 3503221 | 6/1987 | Fed. Rep. of Germany . | |
| 3623609 | 1/1988 | Fed. Rep. of Germany | 266/270 |

*Primary Examiner*—William A. Cuchlinski, Jr.
*Assistant Examiner*—John L. Beres
*Attorney, Agent, or Firm*—Kurt Kelman

[57] ABSTRACT

Refractory, gas-permeable bubbling plugs for a vessel containing a molten metal have a cold end remote from the molten metal and a hot end facing the molten metal. The hot plug end is subject to wear by the heat radiated from the molten metal to leave a remaining plug size after wear, and such plugs comprise at least one measuring probe displaying the remaining plug size. According to the invention, the measuring probe comprises a small tube having a tip extending into the plug and spaced a predetermined distance from the cold plug end, and an end section protruding from the cold plug end, a wire movably mounted within the small tube, a spring preloading the wire, a connection connecting an end of the wire to the tip of the small tube and detachable by the effect of the radiated heat, and an optical display unit attached to the wire in the protruding end section of the measuring probe tube.

7 Claims, 1 Drawing Sheet

REFRACTORY GAS PERMEABLE BUBBLING PLUG

BACKGROUND OF THE INVENTION

1. Field of the Invention

The invention refers to a refractory gas permeable bubbling plug for a vessel for receiving molten metal with at least one measuring probe for displaying the remaining size of the plug, the tip of said measuring probe being arranged in a predefined distance from the cold end of the plug.

2. Description of the Prior Art

It is common practice to introduce various kinds of gases through the refractory lining of vessels into the molten metal. This is done in converters for steel refining, in casting ladles, in tundishes for continuous steel casting and in other types of metallurgical furnaces and vessels. Gas bubbling has a stirring effect in the molten metal or can also give rise to various metallurgical reactions. For this purpose, refractory gas permeable elements are inserted into the refractory lining, most frequently in the bottoms, of furnaces and vessels, said elements being commonly described as bubbling plugs.

Bubbling plugs may either comprise a refractory brick body of high porosity, with the gas flowing through the open pores between the refractory grains, or they may comprise a refractory brick body of low or no porosity, the brick being provided with slots or channels which allow the passage of gases, the latter being referred to as bubbling plugs with aligned porosity.

As a consequence of the interaction between molten metal and the introduced gases, the bubbling plugs are in general subject to higher wear than the surrounding refractory lining. Although there is the tendency to adjust the durability of the bubbling plugs to that of the surrounding lining by choosing an especially wear-resistant refractory material, it is, however, ofter more economical to change the bubbling plugs once or several times during one furnace campaign of the refractory lining.

In order to recognize the correct moment either for changing the bubbling plug or for replacing the refractory lining, it is desirable to arrange a device to the bubbling plug which indicates that the bubbling plug has reached a predefined remaining size.

It has been tried before to optically evaluate the remaining size of the bubbling plug by supervising its hot face. For example, in a bubbling plug having a cross section which expands conically or step-wise in the direction of the cold side, the degree of wear may be derived from the increase in the visible diameter. According to German patent DE-C-31 42 989, the bubbling plug consists of at least two refractory bodies of varying light emisivity, said bodies preferably being intertwined and comprising separation layers in a predefined height of the plug. Whenever wear causes one of said layers to be reached, this shall be recognized by a change of the brightness of the light radiating from the hot surface. However, such optical methods are very unreliable, as an even surface of the bubbling plug—which is mostly not the case—is necessary for precise supervision.

Also electrical display devices are known for supervising wear. According to European patent EP-B-0 082 078, the bubbling plug comprises a plurality of electrodes located in a graduated manner within the height of the plug and insulated from one another, the circuit between said electrodes being closed by the molten metal because of its electric conductivity, said circuit then being displayed. As the contact between the molten metal and the electrodes may easily be interrupted, e.g. by slag inclusions, this arrangement is very susceptible for defects. In order to avoid the above mentioned disadvantage, according to published German patent application DE-A-34 24 466, two electrodes are arranged in a probe which is included in the bubbling plug and is closed towards the hot end of the plug, the tip of the probe being arranged in a certain height of the plug. If the wear of the plug has progressed near to said height of the plug, the ends of the electrodes melt together by the increase in the temperature and thus causing the electric circuit of the display to be closed. According to German patent DE-D-35 03 221, the bubbling plug comprises electric conductors which are arranged in a framework of longitudinal conductors and transverse conductors, the latter being arranged in a graduated manner within the height of the plug. In the unused plug the display circuit is closed. During operation the electric conductor will melt and be interrupted by the increasing approach of the molten metal as a consequence of the increasing wear. According to a variation, the bubbling plug may comprise thermocouples instead of said conductors, the thermocouples being located in different heights of the plug and being connectable to an electric display unit.

In practice the above-mentioned electric display units did not bring about reliable values, as electric connections are very susceptible for defects during the rough operations in a steel plant and especically in the case of moveable vessels, e.g. casting ladles.

The bubbling plug according to German Patent DE-C-36 23 609 comprises in the gas introductory opening a valve with a valve body which is held in the open position by a melting fuse or a bimetallic strip. When the temperature increases as a consequence of wear of the bubbling plug, the melting fuse will melt or the bimetallic strip will be deflected, whereby the valve body will change to a closing position and in which a lower amount of gas will flow through. As in this arrangement the melting fuse or the bimetallic strip are located in some distance away from the molten metal, an unobstructed flow of heat is necessary for a reliable triggering, which, however, might nevertheless be obstructed.

SUMMARY OF THE INVENTION

It is the object of the invention to design a bubbling plug with a display for the remaining size, whereby said display is triggered reliably and effectively by the molten metal under the rough operating conditions in practice.

According to the invention, this object is achieved by a refractory gas permeable bubbling plug of the kind mentioned above with at least one measuring probe for displaying the remaining size, in that the measuring probe comprises a small tube and a wire, said wire being moveably mounted within said small tube and being preloaded by a spring, that the wire at the tip of the measuring probe is connected to the small tube by means of a detachable connection which is detachable by the effect of heat or by contact with the molten metal, and that an optical display unit is attached to the wire in the section of the measuring probe protuberating from the cold end of the plug.

The detachable connection at the tip of the measuring probe may preferably consist of a soldered or welded joint, or it may be formed by a split-pin.

The optical display unit may be formed by a tag attached to said wire and extending outwardly through a gap in the small tube of the measuring probe, or the optical display unit can be formed by a small disc being connected to said wire and being located outside of the small tube.

If the bubbling plug has been worn out to a point near the tip of the measuring probe, the increase in the temperature, for instance by use of solder when reaching temperatures of about 1000° C., or the direct contact of the tip of the measuring probe with the molten metal will lead to the melting of the material forming the connection between the small tube and the wire, and thus the connection is detached. The preloaded wire is pulled back by the spring and this is made clearly visible by the downward movement of the optical display unit.

In order to avoid a welding of the wire with the small tube when the tip of the measuring probe has direct contact with the molten metal, there is the possibility, according to an embodiment of the invention, to provide a ceramic element, e.g. in the form of a small tube or a small disc, between the edge of the small tube and the detachable connection, said ceramic element being penetrated by the wire. For the same purpose the small tube may be filled with a powdery refractory material in which the wire is embedded.

DETAILED DESCRIPTION OF THE PREFERRED EMBODIMENTS

Figure 1:
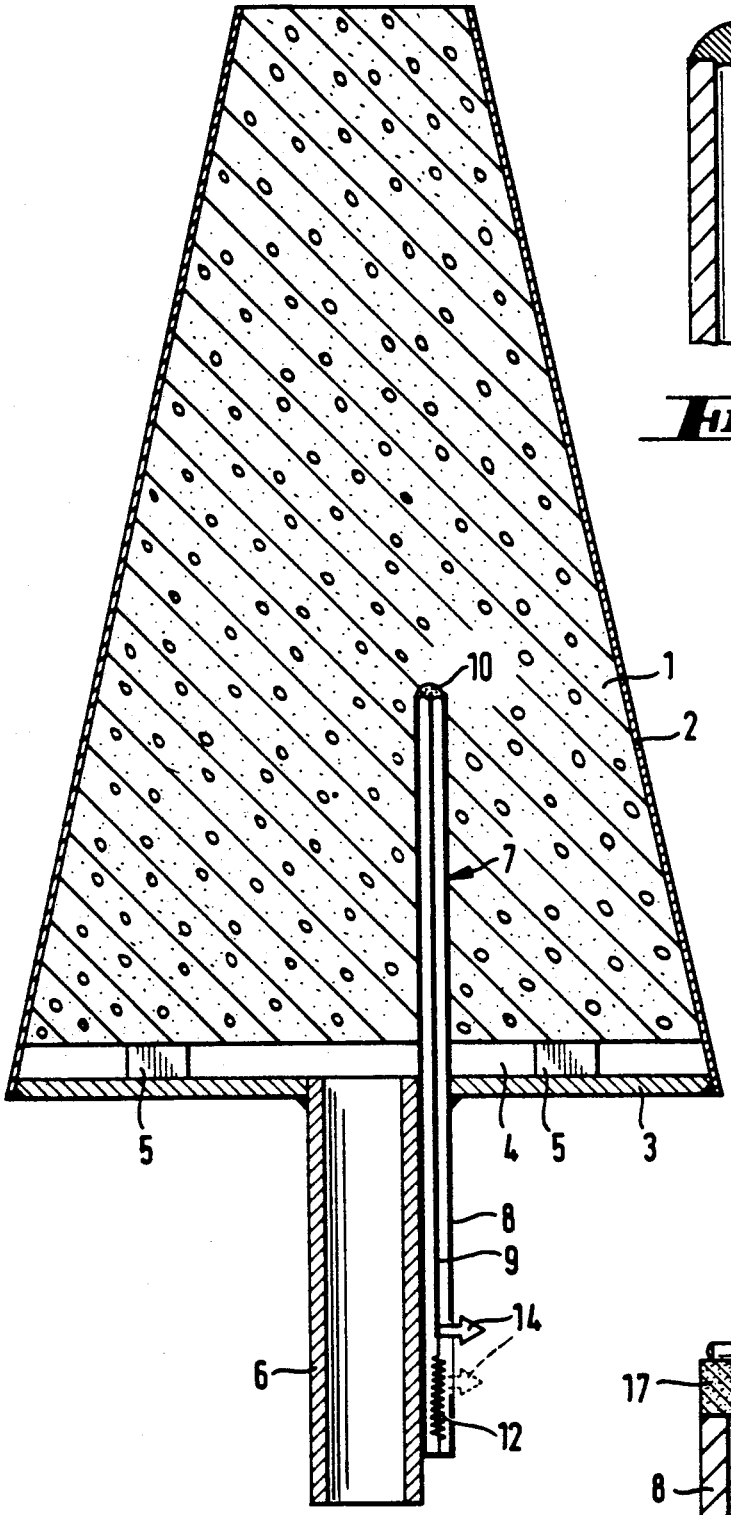
FIG. 1 shows a schematic longitudinal section of the bubbling plug according to the invention with a measuring probe for displaying the remaining size of the bubbling plug.

The refractory bubbling plug 1 is covered by a sheet metal casing consisting of a jacket sheet 2 and a bottom plate 3, the hot-sided upper face remaining open for the exhaust of the bubbling plug 1 and the bottom panel 3, a gas distribution chamber 4 is provided, for instance by the arrangement of some separators 5. A gas supply pipe 6 is attached to bottom plate 3, said gas supply pipe 6 opening into the gas distribution chamber 4.

Figure 2:
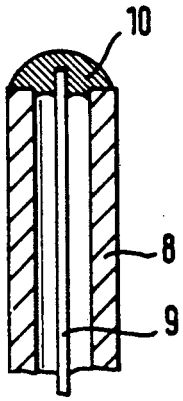
FIGS. 2 to 4 show enlarged sections of three embodiments of the tip area of the measuring probe and FIG. 5 a variation of the display area of the measuring probe.

Bubbling plug 1 comprises a measuring probe 7, the tip of said measuring probe being arranged at a predefined distance from the cold-sided end of the plug. The measuring probe 7 penetrates the bottom plate 3 and the gas distribution chamber 4 and with its lower section it extends outwardly from the cold-sided end of the plug, suitably leaning to the gas supply pipe 6. The measuring probe 7 comprises a small tube 8, for instance a steel tube having an outide diameter of 2 to 5 mm and a wall thickness of 0.5 to 1 mm, and a wire 9, said wire having a diameter of e.g. 0.5 to 1 mm and being moveably arranged in said small tube 8. At the tip of the measuring probe 7 the wire 9 is connected to the small tube 8 by means of a detachable connection which is detachable by the effect of heat of molten metal. In the embodiment shown in FIG. 1 and 2, said detachable connection consists of a soldered or welded joint 10. The wire 9 is preloaded in the small tube 8 by a spring, said spring being preferably fixed at the lower end of small tube 8. In the embodiment shown in FIG. 1, said spring is a tension spring 12. Near tension spring 12, a tag 14 is attached to the wire 9, said tag forming the optical display unit and extending outwardly through a gap provided in the small tube 8.

During the increasing wear of bubbling plug 1 the molten metal approaches the tip of measuring probe 7 and melts the soldered or welded joint 10. Thereby the connection between the small tube 8 of said measuring probe 7 and the wire 9 is detached, said wire 9 is pulled down by tension spring 12, and as a consequence, tag 14 attached to wire 9 is also pulled down, thereby indicating that the bubbling plug has reached the predefined remaining size.

Figure 3:
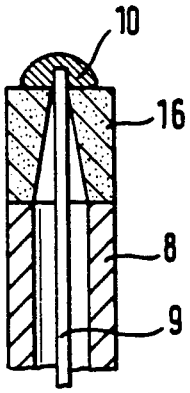

In the embodiment of the tip area of measuring probe 7 shown in FIG. 3, a ceramic element in the form of a small ceramic tube 16 is provided between the top edge of small tube 8 and the soldered or welded joint 10.

Figure 4:
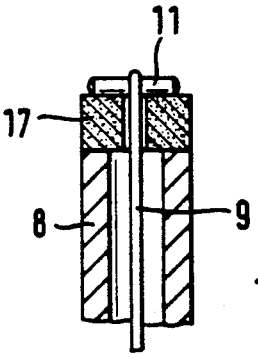

In the embodiment of the tip area of measuring probe 7 shown in FIG. 4, the detachable connection is formed by a split-pin 11. A ceramic element in the form of a small ceramic disc 17 is inserted between said split-pin 11 and the upper edge of small tube 8.

The small ceramic tube 16 and the small ceramic disc 17 have the purpose to prevent a welding of the wire 9 with the small tube 8 by the molten metal and to secure a reliable detachment of the connection formed by the soldered or welded joint 10 or by the split-pin 11. For this purpose, the small tube 8, may be filled with a powdery refractory material 18, e.g. magnesia flour, wire 9 being embedded therein, as shown in FIG. 5.

Figure 5:
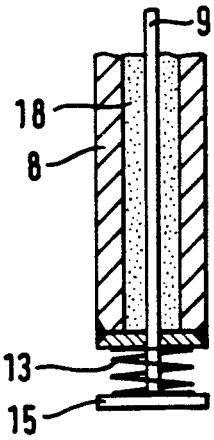

FIG. 5 also shows a further embodiment of the display area of the measuring probe 7. In this embodiment, a pressure spring 13 is used for loading wire 9, said pressure spring being arranged between the lower end of small tube 8 and a small disc 15, said disc being attached to wire 9. The small disc 15 serves as a display for the remaining size of the bubbling plug, as said small disc jumps away by the effect of pressure spring 13 after the detachment of the connection at the tip of the measuring probe.

When the bubbling plug is produced by pressure moulding, the hole for including the measuring probe 7 is preferably drilled into the completed bubbling plug. When the bubbling plug is produced by casting refractory material, the measuring probe 7 can be casted in directly.

I claim:

1. A refractory, gas-permeable bubbling plug for a vessel containing a molten metal radiating heat, the plug having a cold end remote from the molten metal and a hot end facing the molten metal, the hot plug end being subject to wear by the heat radiated from the molten metal to leave a remaining plug size after wear, and the plug comprising at least one measuring probe displaying the remaining plug size, the measuring probe comprising a small tube having a tip extending into the plug and spaced a predetermined distance from the cold plug end, and an end section protruding from the cold plug end, a wire movably mounted within the small tube, a spring preloading the wire, a connection connecting an end of the wire to the tip of the small tube and detachable by the effect of the radiated heat, and an optical display unit attached to the wire in the protruding end section of the measuring probe tube.

2. The bubbling plug of claim 1, wherein the detachable connection consists of a soldered or welded joint.

3. The bubbling plug of claim 1, wherein the detachable connection is constituted by a split pin.

4. The bubbling plug of claim 1, further comprising a ceramic element arranged between the tip of the small tube and the detachable connection, the wire passing through the ceramic element to the connection.

5. The bubbling plug of claim 1, wherein the optical display unit comprises a tag attached to the wire and extending outwardly through a gap in the small tube of the measuring probe.

6. The bubbling plug of claim 1, wherein the optical display unit comprises a small disc connected to the wire and located outside the small tube of the measuring probe.

7. The bubbling plug of claim 1, further comprising a powdery refractory material surrounding the wire and filling the small tube.

* * * * *